US008302348B2

(12) United States Patent
Noyes

(10) Patent No.: US 8,302,348 B2
(45) **Date of Patent: *Nov. 6, 2012**

(54) AUTOMATIC PET DOOR

(75) Inventor: Crosby S. Noyes, Sorrento, ME (US)

(73) Assignee: Crucible Corporation, Sorrento, ME (US)

( * ) Notice: Subject to any disclaimer, the term of this patent is extended or adjusted under 35 U.S.C. 154(b) by 381 days.

This patent is subject to a terminal disclaimer.

(21) Appl. No.: 12/692,714

(22) Filed: Jan. 25, 2010

(65) Prior Publication Data

US 2010/0116219 A1 May 13, 2010

Related U.S. Application Data

(63) Continuation-in-part of application No. 11/085,384, filed on Mar. 21, 2005, now abandoned.

(51) Int. Cl.
*E05F 11/52* (2006.01)

(52) U.S. Cl. ..... 49/169; 49/163; 160/116; 160/180; 119/484; 119/485; 119/622

(58) Field of Classification Search ..... 49/169, 49/163; 160/116, 180; 119/416, 484, 485, 119/622; D30/180
See application file for complete search history.

(56) References Cited

U.S. PATENT DOCUMENTS

| | | | | |
|---|---|---|---|---|
| 45,774 | A | 1/1865 | Warnick et al. | |
| 1,460,945 | A | 7/1923 | Chaplin | |
| 1,820,456 | A * | 8/1931 | Ichio | 49/48 |
| 2,030,089 | A * | 2/1936 | Anderson | 49/163 |
| 2,067,088 | A * | 1/1937 | Kellogg | 49/146 |
| 3,403,474 | A | 10/1968 | Spasoff | |
| 3,548,611 | A | 12/1970 | Ulich | |
| 4,029,048 | A | 6/1977 | Gershbein | |
| 4,224,899 | A | 9/1980 | Cruchelow et al. | |
| 4,291,645 | A | 9/1981 | Cruchelow et al. | |
| 4,322,913 | A * | 4/1982 | Himmer | 49/168 |
| 4,445,459 | A | 5/1984 | Julie | |
| 4,674,231 | A | 6/1987 | Radek et al. | |
| 4,989,546 | A | 2/1991 | Cannaday | |
| 4,995,336 | A | 2/1991 | Deemer et al. | |
| 5,148,767 | A | 9/1992 | Torchio | |
| 5,165,366 | A | 11/1992 | Harvey | |
| 5,167,202 | A | 12/1992 | Bradford et al. | |
| 5,177,900 | A * | 1/1993 | Solowiej | 49/363 |
| 5,261,350 | A | 11/1993 | Vavrek | |
| 5,469,807 | A | 11/1995 | Kosmaczeska | |
| 5,522,344 | A | 6/1996 | Demurjian | |
| 5,842,438 | A | 12/1998 | Messmer | |
| 5,872,516 | A | 2/1999 | Bonge | |
| 5,890,455 | A | 4/1999 | Donchey | |
| 5,967,215 | A | 10/1999 | Needham | |
| 5,992,096 | A | 11/1999 | De La Cerda et al. | |
| D424,249 | S | 5/2000 | Banzaca | |
| 6,141,911 | A | 11/2000 | Reid | |
| 6,253,711 | B1 | 7/2001 | Shibles | |
| 6,297,739 | B1 | 10/2001 | Small | |
| 6,401,663 | B1 | 6/2002 | Meier, Jr. | |
| 6,453,847 | B2 | 9/2002 | Brooks | |
| 6,637,160 | B2 * | 10/2003 | Brooks | 52/66 |
| 6,658,793 | B2 | 12/2003 | Perron | |
| 6,691,463 | B1 * | 2/2004 | Richmond | 49/360 |

(Continued)

*Primary Examiner* — Katherine W Mitchell
*Assistant Examiner* — Marcus Menezes
(74) *Attorney, Agent, or Firm* — Anthony D. Pellegrini

(57) ABSTRACT

An automatic pet door device having a pet-specific identification component whereby only authorized animals are permitted to access the pet door.

10 Claims, 13 Drawing Sheets

U.S. PATENT DOCUMENTS 6,944,990 B2 * 9/2005 Noyes ..... 49/169
6,966,147 B2 * 11/2005 Solowiej ..... 49/169
2003/0204996 A1 11/2003 Gillett

* cited by examiner

AUTOMATIC PET DOOR

CROSS REFERENCE TO RELATED APPLICATIONS

This application is a continuation in part of U.S. Ser. No. 11/085,384, filed Mar. 21, 2005 and now abandoned (as of May 12 2010), entitled Window Mounted Pet Door, by Noyes, Crosby S., which is hereby incorporated by reference. This application further claims priority to U.S. Pat. No. 6,944, 990 (U.S. Ser. No. 10/320,522), filed Dec. 17, 2002 and issued on Sep. 20, 2005, entitled Window Mounted Automatic Pet Door, by Noyes, Crosby S., which is hereby incorporated by reference.

BACKGROUND OF THE INVENTION

1. Technical Field

The invention relates generally to the field of pet doors and is directed to a device comprising a pet-specific identification component and a powered door. More specifically, the invention is directed to an improved automatic pet door device designed to be easily installed and deinstalled in a variety of locations, with features allowing only designated pets to use the device.

2. Description of Prior Art

Pet door devices have been well-know in the field. Early pet door devices were mounted in doors or cut into walls, and consisted of a door panel hinged at the top edge and operated by the pet applying a force against the door panel to allow for through passage. While these early devices permitted pets egress and ingress without the need for owner attention, any animal (or even children or intruders) could pass through the pet door. Subsequent designs sought to incorporate various locking mechanisms with corresponding keys, to allow only certain pets access. Other devices employed power, to allow the pet door to be opened and closed without resort to the pet applying a force against the door panel.

The prior art discloses various pet door devices. One example of a prior art pet door is disclosed in U.S. Pat. No. 5,967,215 (Needham), issued on Oct. 19, 1999. This patent discloses a one- and two-way pet screen door kit for installation in an existing screen door or window screen. This device uses magnetic latches to control access. It does not make use of a pet-specific identification device; any animal carrying a magnetic key will be provided access. The door is also not powered, relying on contact by the animal to push it open.

A device which improves on the concept disclosed in '215 (Needham) is U.S. Pat. No. 6,141,911 (Reid), issued on Nov. 7, 2000. '911 (Reid) discloses a pet door providing access via a door with a locking/unlocking mechanism activated by a pet-specific key device consisting of a tuned receiver and a signal transmitting key. This allows individual pets to be identified for access, whereby a simple magnetic key permits access to any pet carrying a magnetic key. However, the other deficiencies noted in '215 (Needham) remain with '911 (Reid). Moreover, by utilizing a signal transmitting key, the key device in '911 (Reid) may be overly large and uncomfortable for a pet to wear, and may also present safety concerns.

U.S. Pat. No. 5,872,516 (Bonge), issued Feb. 16, 1999, discloses a remotely operated pet door which automatically opens under its own power when it receives a signal from an ultrasonic transmitter worn by a pet. This device represents yet another improvement over the concepts disclosed above, in that the door is powered. It does not address the other deficiencies. U.S. Pat. No. 5,177,900 (Solowiej), issued Jan. 12, 1993, discloses an automatic pet door having a vertically moving door activated by a radiation transmitter worn by the pet. This device is similar in concept to '516 (Bonge), except it uses radio signals instead of ultrasonic signals.

U.S. Pat. No. 6,297,739 (Small), issued on Oct. 2, 2001, discloses a powered automatic pet door using a combination of a pet-specific identification device, a weight sensor, and a motion sensor to control access. The identification device may be implanted subcutaneously in the body of the pet. It also utilizes an interface to a home security system.

From the foregoing there is a clear need for an improved automatic pet door device having simplified pet identification means that is easy to install and use.

It is therefore an objective of the present invention to provide an improved automatic pet door device which is pet-specific in operation.

It is a further objective of the present invention to provide an improved automatic pet door device which incorporates a simplified pet-identification mechanism.

It is a further objective of the present invention to provide an improved automatic pet door device whereby the pet-identification mechanism is not burdensome to the pet.

It is a further objective of the present invention to provide an improved automatic pet door device which incorporates a simplified form factor for easy installation in any number of locations and orientations.

Other objectives of the present invention will be readily apparent from the description that follows.

SUMMARY

The present invention discloses a versatile pet access appliance which combines the best features of the prior art together in an improved convenient form factor for ease of installation and use. In one aspect, the present invention is directed to an automatic pet door device having a pet-specific identification component whereby only authorized animals are permitted to access the pet door. The device comprises a casing, having a housing component, a door positioning component, and an identification component, wherein the casing contains a pet access aperture through which a pet may pass and a sliding door suitably adapted for covering and uncovering the pet access aperture, the door positioning component is electrically powered and activated by the pet and moves the door to cover and uncover the pet access aperture, and the identification component discerns between individual animals and permits access through the door only to designated pets under predetermined conditions. The device is intended to be used with a variety of pets, such as cats and dogs.

The casing of the device is designed to present a relatively small form factor for ease of installation in various structures and in various orientations. One aspect of the device employs ramps so that access to the device may be had by pets when the device is installed in an elevated location. The device makes use of a pet-specific identification component, so that different pets in the neighborhood, or even within the same household, can be selectively permitted or denied access to the device.

Other features and advantages of the invention are described below.

DESCRIPTION OF THE INVENTION

Figure 1:
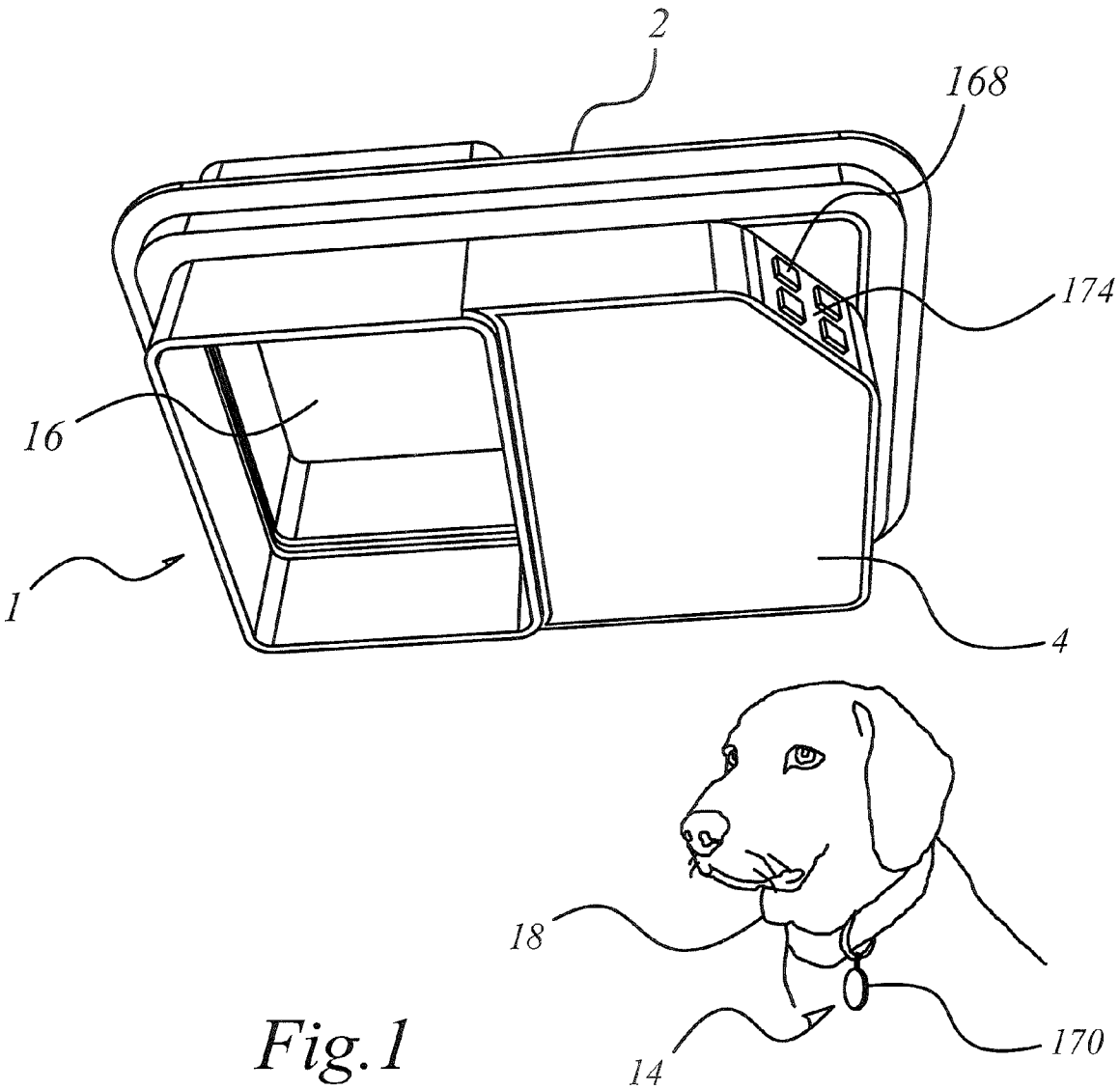
FIG. 1 is a perspective front/top view of the device.

FIG. 1 shows a perspective view of one embodiment of an automatic pet door device 1. The device 1 comprises a pet identification component 14 permitting only designated animals 18 to use the device 1. The device 1 is intended to permit pets 18 to enter or exit a structure, such as a house, garage, or other building, in a controlled manner, with a minimum of effort, and without the need for direct participation by the pet owner.

The basic components of the device 1 include a casing 2, which in turn incorporates a housing component 4 and a pet access aperture 16, a door 20 adapted to cover and uncover the pet access aperture 16, a door positioning component 12, and an identification component 14. See FIG. 1. The casing 2 contains the other components which are enclosed within the housing component 4 and/or integrated into and attached to the casing 2. The door positioning component 12 comprises electrical and mechanical means for moving the door 20 across the pet access aperture 16, thereby covering and uncovering the pet access aperture 16, whereby a pet 18 may pass through the pet access aperture 16 when it is in an uncovered, or open, state, and the pet 18 is prevented from passing through the pet access aperture 16 when it is in the covered, or closed, state. The door positioning component 12 is adapted to position the door 20 without the need for the pet 18 to contact the door 20. The door positioning component 12 also provides security for the device 1, maintaining the door 20 in a closed position until the device 1 is properly accessed by a designated pet 18 or by the user. The door positioning component 12 is contained within the housing component 4, thereby protecting it from the elements and also minimizing the likelihood that the moving elements of the door positioning component 12 will come in contact with the pet 18, so as to avoid injury. The identification component 14 is adapted to activate the door positioning component 12 when an authorized pet 18 is identified so that the pet 18 may pass through the pet access aperture 16, initiating a sequence of steps for uncovering the pet access aperture 16 and then covering the pet access aperture 16 with the door 20. In one embodiment, the identification component 14 is comprised of at least two subcomponents, one of which, the key device 170, is carried by the pet 18, the other of which is integrated with the casing 2. See FIG. 1. In this embodiment, the identification component 14 is adapted to be activated when a pet 18 carrying the key device 170 comes within a predetermined near proximity to the door 20 of the device 1; when such occurs, the identification component 14 resolves whether the pet 18 is permitted access, and if so, activates the door positioning component 12 to position the door 20 in the open position, thereby permitting the pet 18 to pass through the pet access aperture 16. The identification component 14 may be configured to accept only certain individual pets 18 carrying a key device 170, or to permit passage of a pet 18 through the pet access aperture 16 in only one direction (e.g., only to let the pet 18 in or only to let the pet 18 out), or to limit the time periods during which a pet 18 may activate the door 20, or any combination of the foregoing.

In one embodiment, the housing component 4 is constructed of a rigid material which defines a substantially enclosed space. This configuration protects the other components of the device 1 located within the housing 4 from exposure to the environment or to the pet 18. The housing component 4 may be constructed of plexiglass, polystyrene, or other such materials providing strength and rigidity along with being light weight. The housing component 4 may be transparent, translucent, tinted, or opaque. In one embodiment a side of the housing component 4 may be removably attached to the rest of the housing component 4, thereby providing access to the interior of the housing component 4.

Figure 2A:
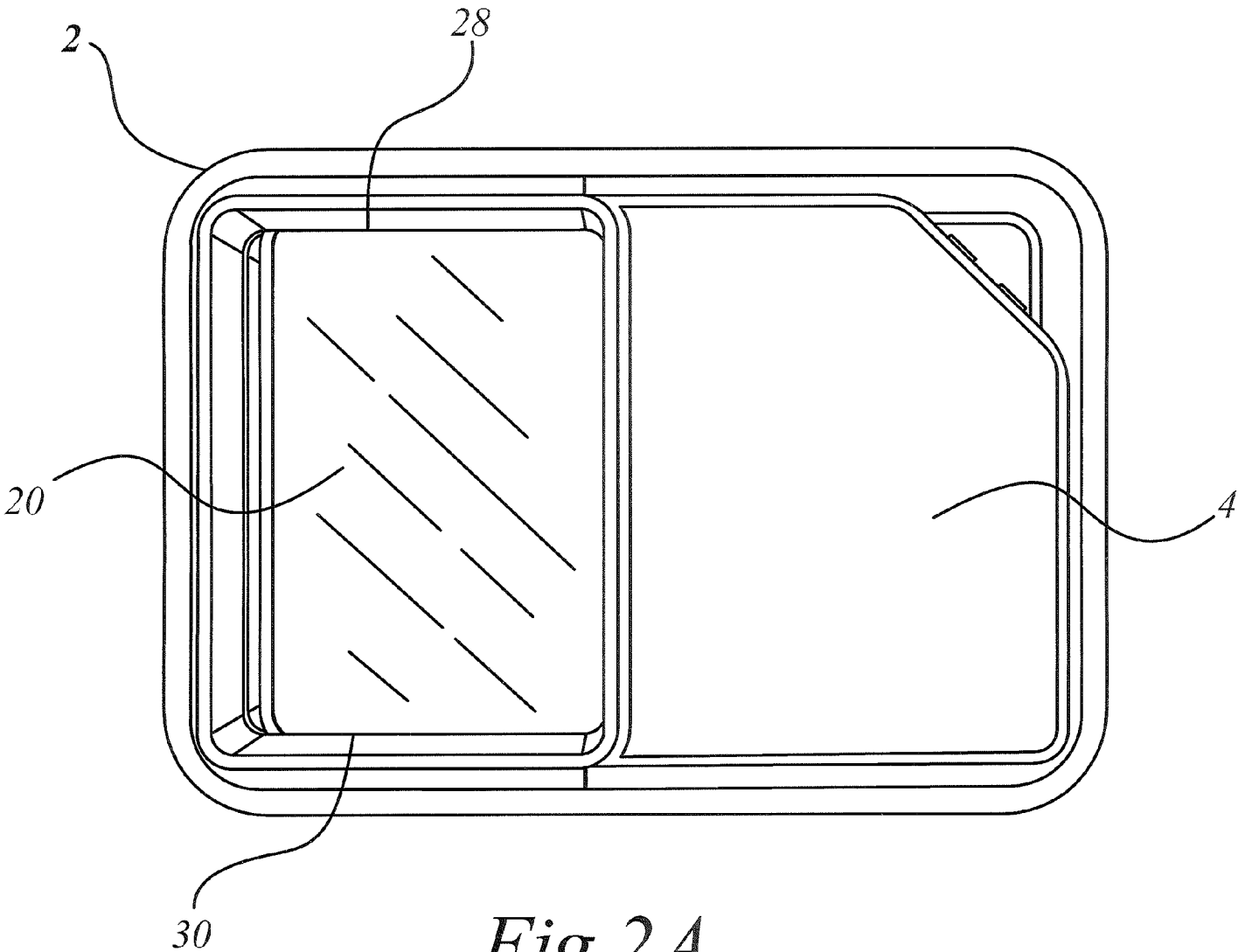
FIG. 2A is a plan front view of the device depicting the door in the partially closed position.
Figure 2B:
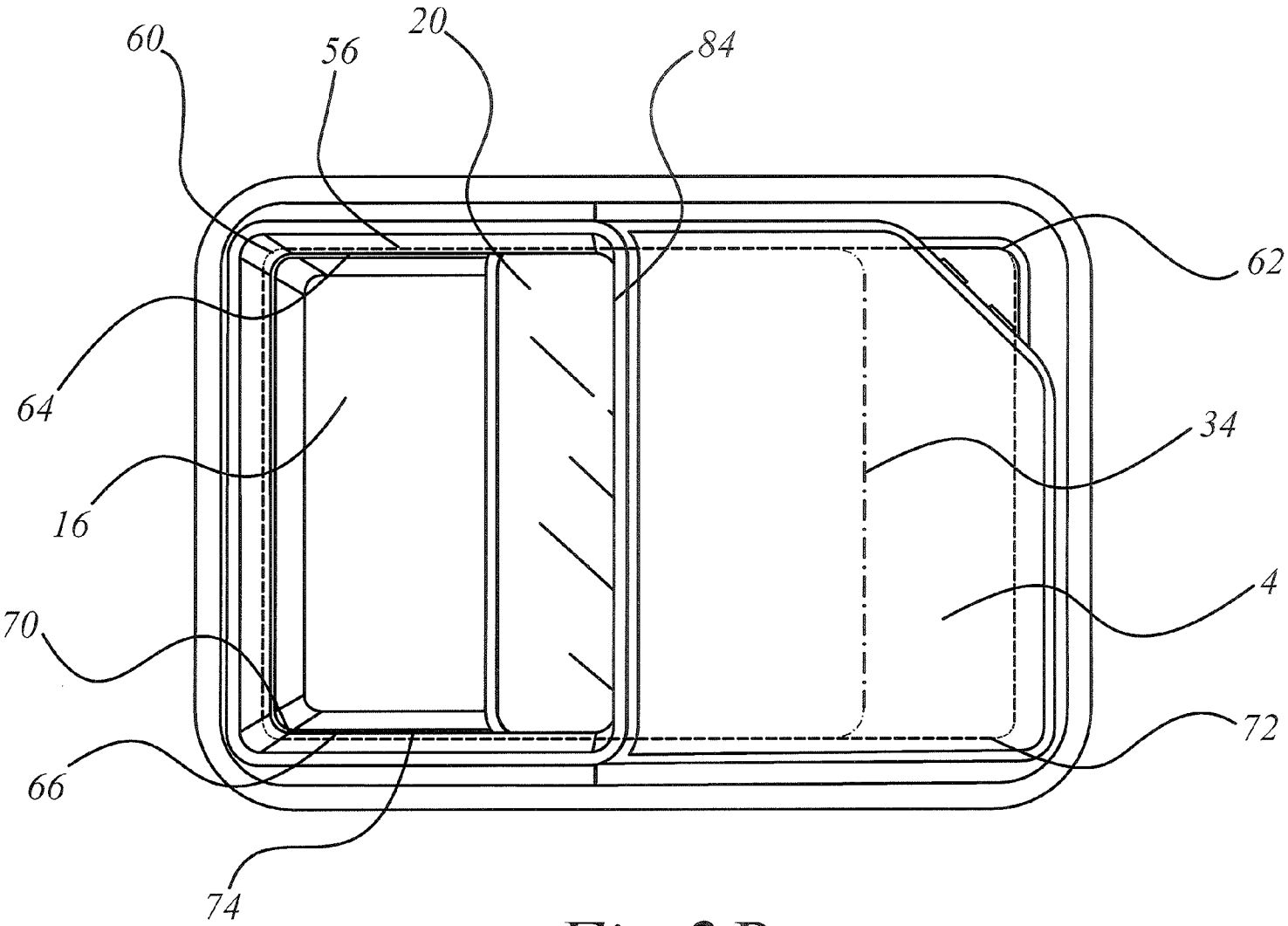
FIG. 2B is a plan front view of the device depicting the door in the opened position (portions of door within housing are depicted in ghost line).
Figure 10:
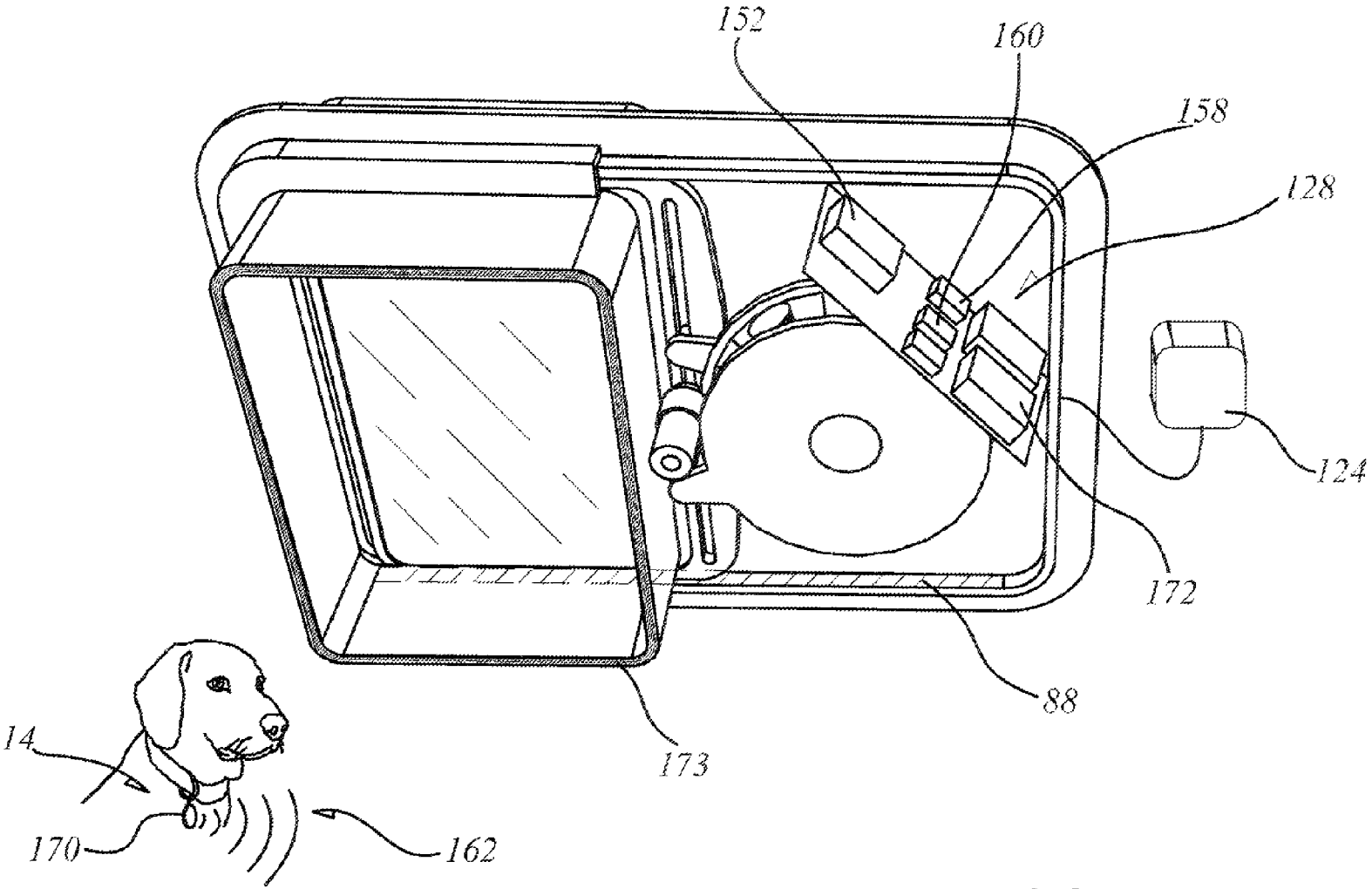
FIG. 10 is a perspective front/top view of the device, partially disassembled to provide a view of the interior of the housing and of one embodiment of the door positioning mechanism, further depicting one embodiment of the control component.

The pet access aperture 16 is situated within the casing 2 adjacent to the housing component 4. The door 20 controlling access through the device 1 is planar, is constructed of a rigid material, is of a uniform thickness, is substantially rectangular in shape, and is suitably dimensioned to substantially cover the pet access aperture 16. See FIG. 2A. Other shapes for the door 20 which accomplish the task of completely covering the pet access aperture 16 are also anticipated by this invention. In one embodiment the door 20 is constructed of a transparent, colorless material, thereby giving the pet 18 a clear view through the device 1. In another embodiment of the device 1, the pet access aperture 16 is substantially rectangular and defined by an upper track 56 and a lower track 66, each having a first end 60,70 and a second end 62,72, which comprise the top and bottom edges of the pet access aperture 16. See FIG. 2B. Each of the tracks 56, 66 is constructed of a rigid material. The tracks 56, 66 each comprise a u-shaped channel 64, 74 suitably dimensioned to accommodate the thickness of the door 20. The housing component 4 contains a vertical door aperture 84 adjacent to the pet access aperture 16 and suitably adapted to accommodate the thickness of the door 20. In this embodiment the second end 62 of the upper track 56 extends through the vertical door aperture 84 and into the housing component 4, with the u-shaped channel 64 of the upper track 56 oriented substantially downward. The second end 72 of the lower track 66 extends through the vertical door aperture 84 and into the housing component 4, with the u-shaped channel 74 of the lower track 66 oriented substantially upward and with the lower track 66 oriented substantially parallel to and in alignment with the upper track 56. The upper edge 28 of the door 20 is situated within the u-shaped channel 64 of the upper track 56 and the lower edge 30 of the door 20 is situated within the u-shaped channel 74 of the lower track 66. When the door 20 is opened the upper and lower edges 28, 30 of the door 20 slide along the upper and lower tracks 56, 66, respectively, and the near side edge 34 of the door 20 passes through the vertical door aperture 84 as the door 20 is drawn into the housing component 4. The upper and lower tracks 56,66 may further comprises a lubricating material 88 set within the u-shaped channels 64,74 of the tracks 56,66, thereby facilitating the movement of the door 20 along said tracks 56,66. See FIG. 10. In one embodiment the tracks 56, 66 may be formed into the casing 2 as a single unit.

Figure 8:
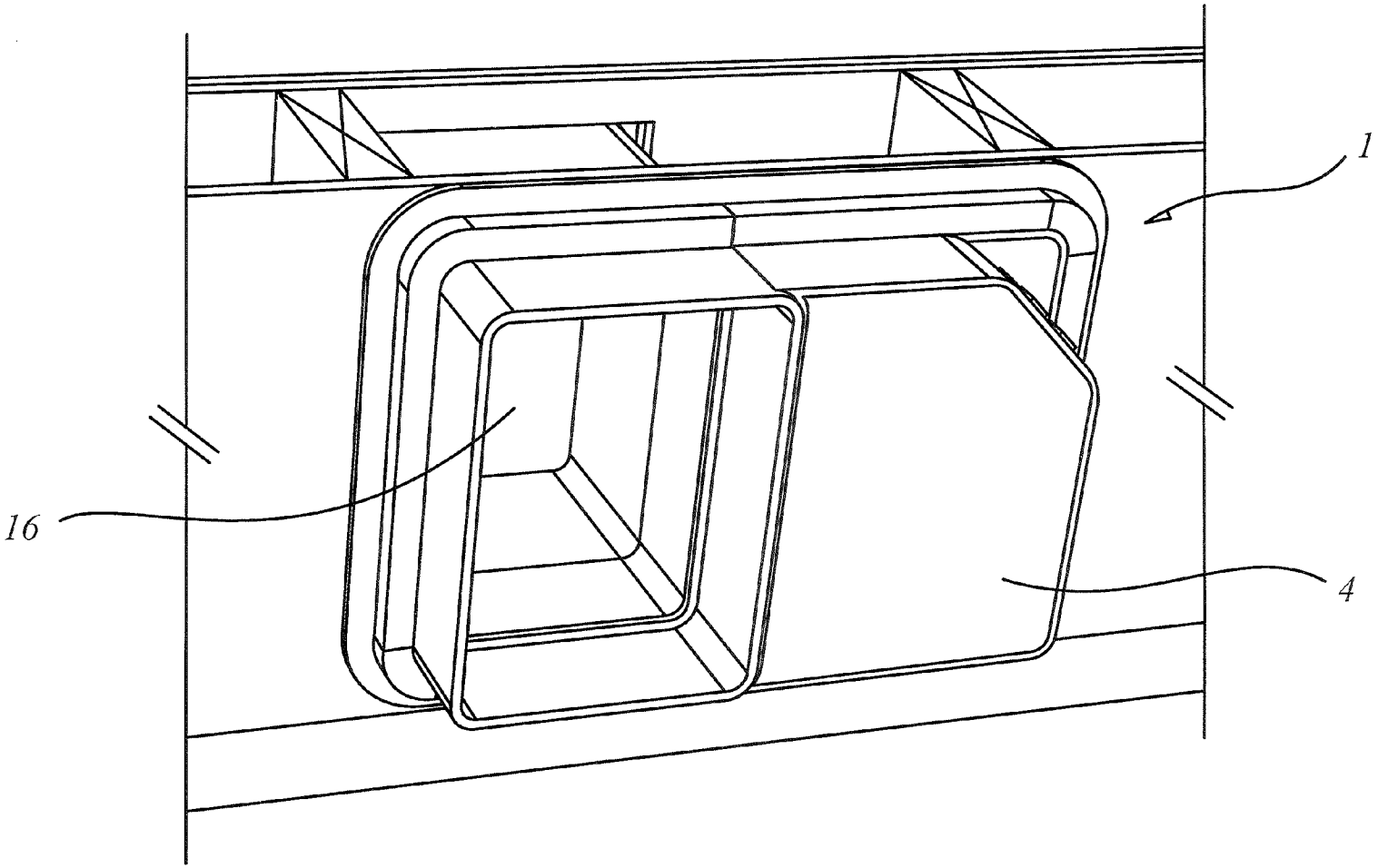
FIG. 8 is a perspective front/top view of the device installed within a wall.
Figure 9:
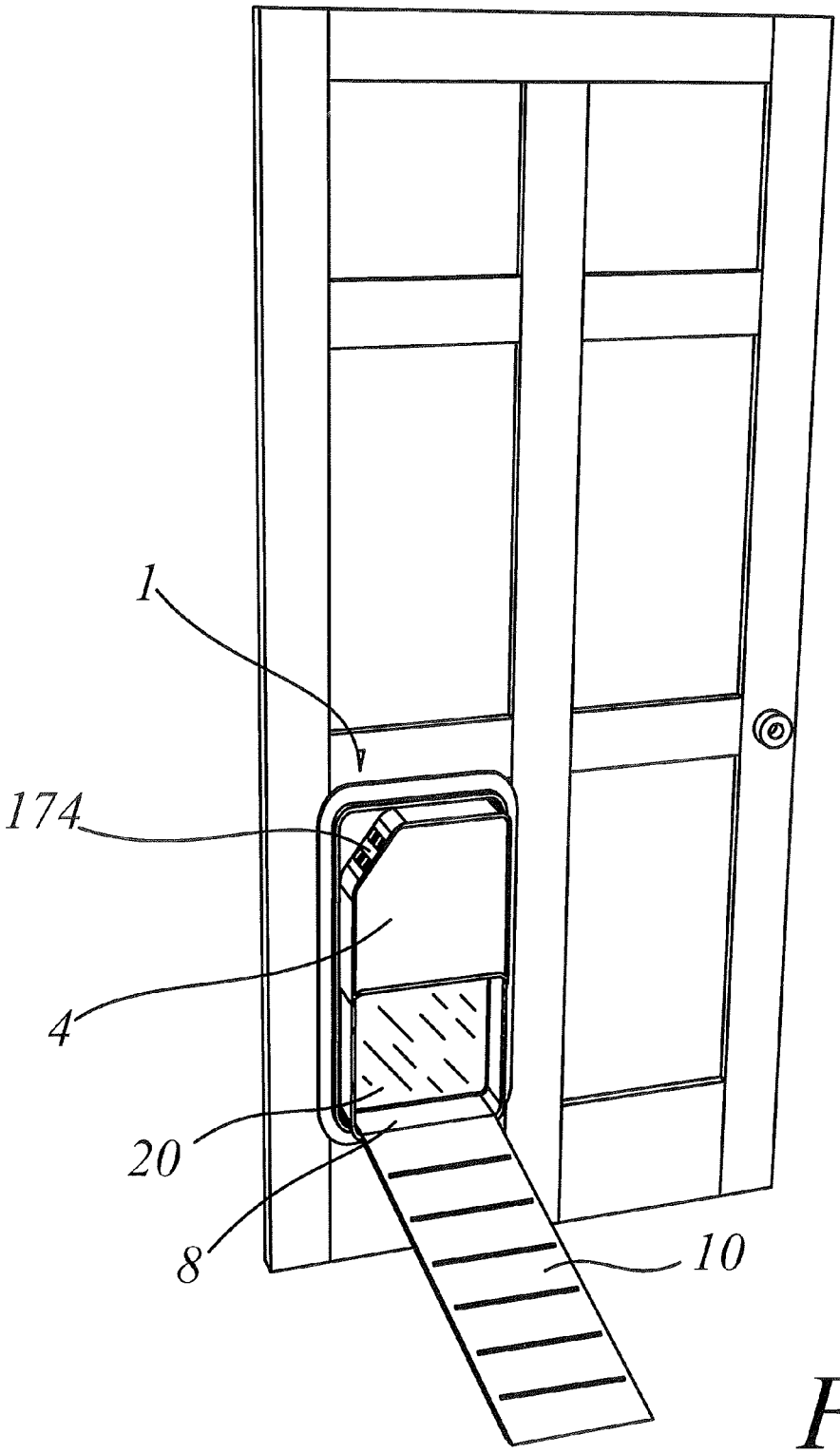
FIG. 9 is a perspective front view of the device installed within a door in a vertical orientation.

The device 1 is configured to permit installation in different orientations. In one installation, the device 1 is oriented horizontally, with the housing 4 located lateral of the pet access aperture 16. See FIG. 8. The door 20 is moved laterally (that is, movement remains substantially within a single plane) into the housing 4 to achieve the opened position. In an alternative installation, the device 1 is oriented vertically, with the housing 4 located above of the pet access aperture 16. See FIG. 9. The door 20 is moved vertically into the housing 4 to achieve the opened position.

Figure 6:
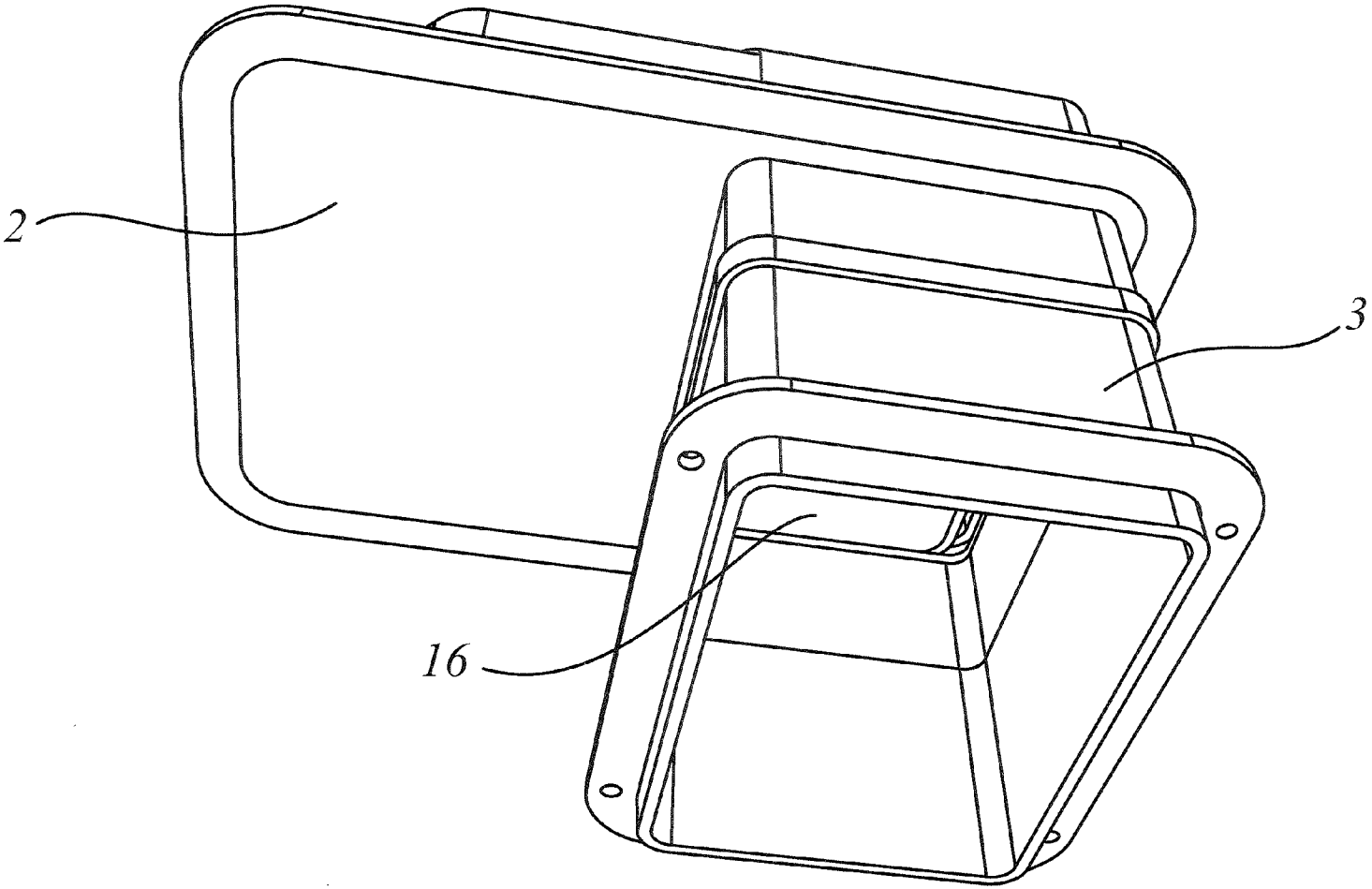
FIG. 6 is a perspective front/top view of the device employing a through wall extension tube.
Figure 7:
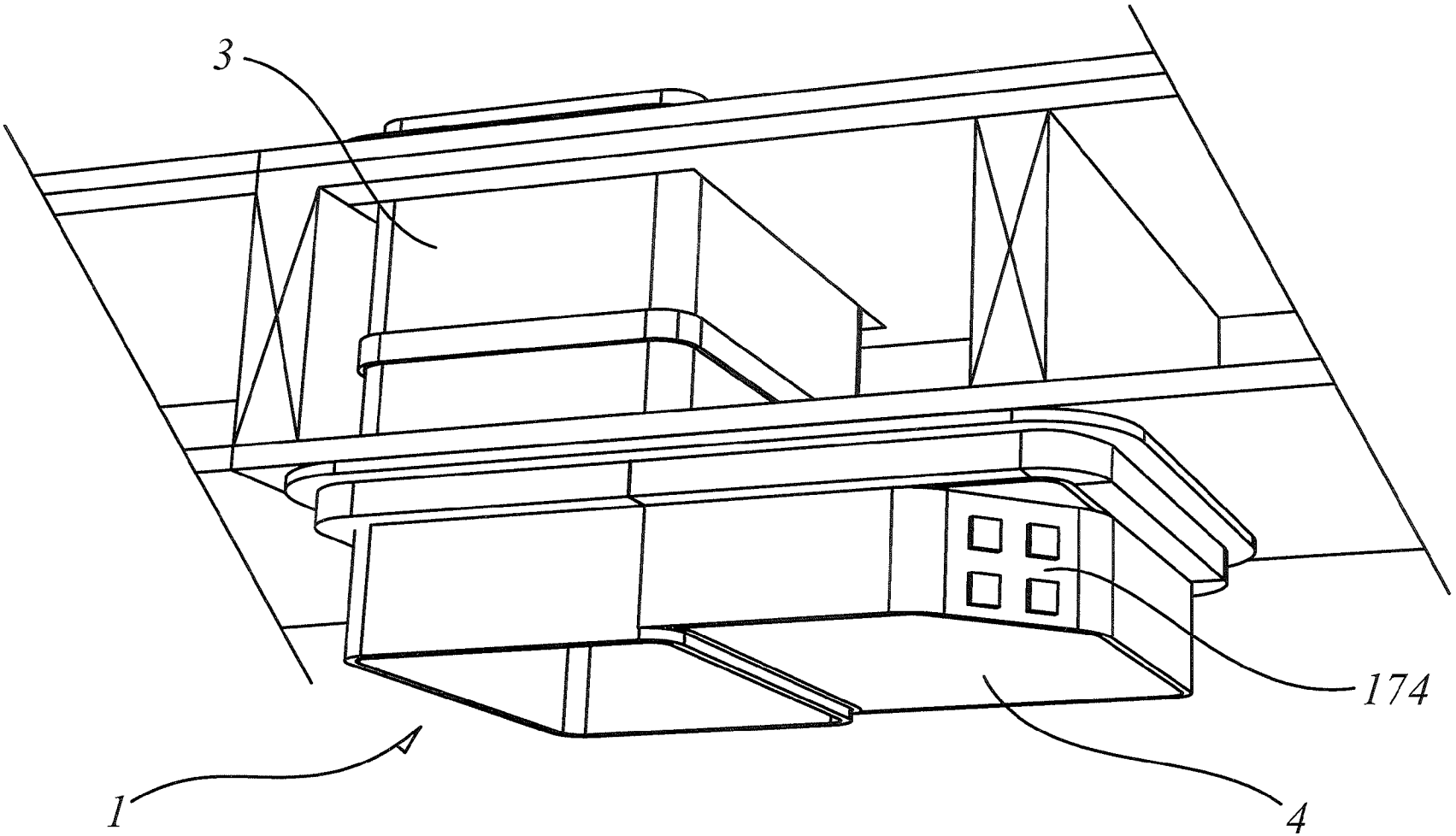
FIG. 7 is a perspective top view of the device employing a through wall extension tube as the device is placed within a wall (wall depicted in section).

In one embodiment, the casing 2 further comprises a through wall extension tube 3. See FIGS. 6 and 7. The through wall extension tube 3 is in communication with the pet access aperture 16 and provides for greater depth to allow the device 1 to be installed in a wall having greater thickness.

In another embodiment, the casing 2 further comprises a pet access platform 8 to permit easier access to the device 1. A ramp 10 may be integrated with the pet access platform 8 so that access to the device 1 may be had by pets 18 when the device 1 is installed in an elevated location. See FIG. 9.

Figure 11:
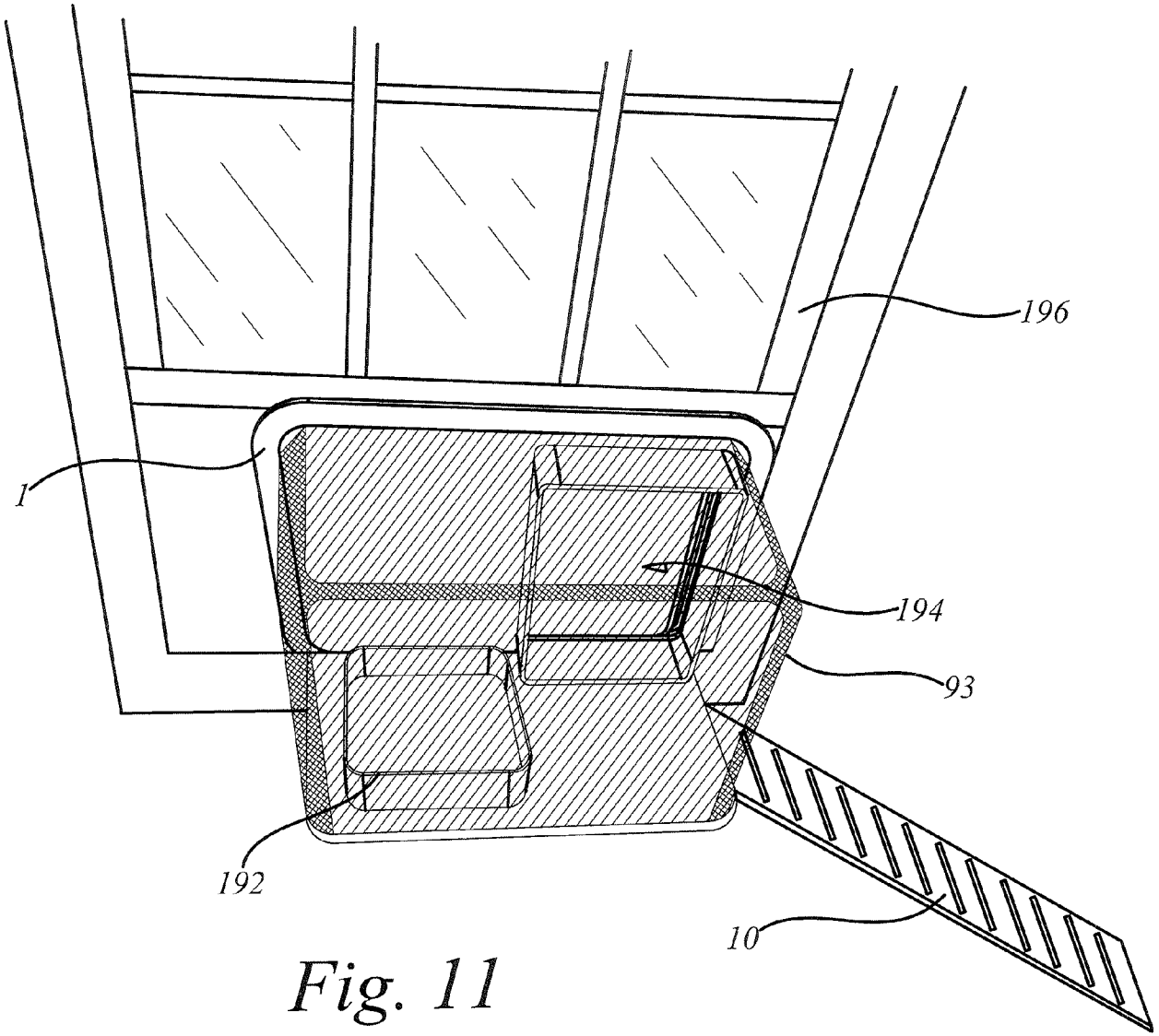
FIG. 11 is a perspective front view of the device installed within a window with add-on accessories.

In another embodiment, the casing 2 further comprises an enclosure 93 removably attached to the exterior of the casing 2, such that the enclosure 93 fully encloses the area immediately adjacent to the exterior of the casing 2. See FIG. 11. This feature is useful, for example, in urban areas where a pet 18 is allowed only restricted egress through the device 1 for safety reasons. The enclosure 93 may be suitably dimensioned to accommodate a litter box 192, and may be suitably adapted to provide fresh air through apertures 194 and viewing opportunities through windows or clear structural elements, such as walls constructed of a transparent material. In the preferred embodiment the device 1 is placed in a double-hung window 196.

The door positioning component 12 comprises an electric motor 120, a power supply 124, a mechanical positioning component 126, and a control component 128. See FIG. 10. The power supply 124 provides power to the electric motor 120, enabling it to operate. The control component 128 determines when and in which direction the electric motor 120 operates. The electric motor 120, when operating, moves the mechanical positioning component 126, which in turn positions the door 20 to uncover or cover the pet access aperture 16. In one embodiment the electric motor 120 is situated within the housing 4 and is configured to operate within a limited space to ensure a compact form factor for the device 1. The power supply 124 may comprise a 110 volt A/C to 12 volt D/C converter with a standard plug at one end, enabling it to be plugged into a standard wall outlet and enabling the device 1 to run on 12 volt D/C.

In one embodiment the mechanical positioning component 126 comprises a disk 130 capable of rotation by the electric motor 120. The disk 130 is oriented in a plane parallel to the plane of travel of the door 20. The disk 130 comprises a pin 134 depending substantially vertically from the disk 130 and located proximate to the edge of the disk 130. The pin 134 may be located on a small flange 136 extending from the edge of the disk 130, said flange 136 located substantially within the plane of the disk 130. The pin 134 is adapted to fit into a vertical slot 36 formed into the door 20 proximate to the near edge 34 of the door 20. Rotation of the disk 130 moves the pin 134 along an arc, simultaneously sliding the pin 134 along the door slot 36, moving the door 20. When the electric motor 120 operates in a first direction, the disk 130 is rotated in one direction, with its pin 134 moving along the door slot 36 to move the door 20 smoothly in a first direction. When the electric motor 120 operates in a second direction, the disk 130 is rotated in an opposite direction, with its pin 134 moving along the door slot 36 in an opposite direction to move the door 20 smoothly in a second direction.

Figure 3:
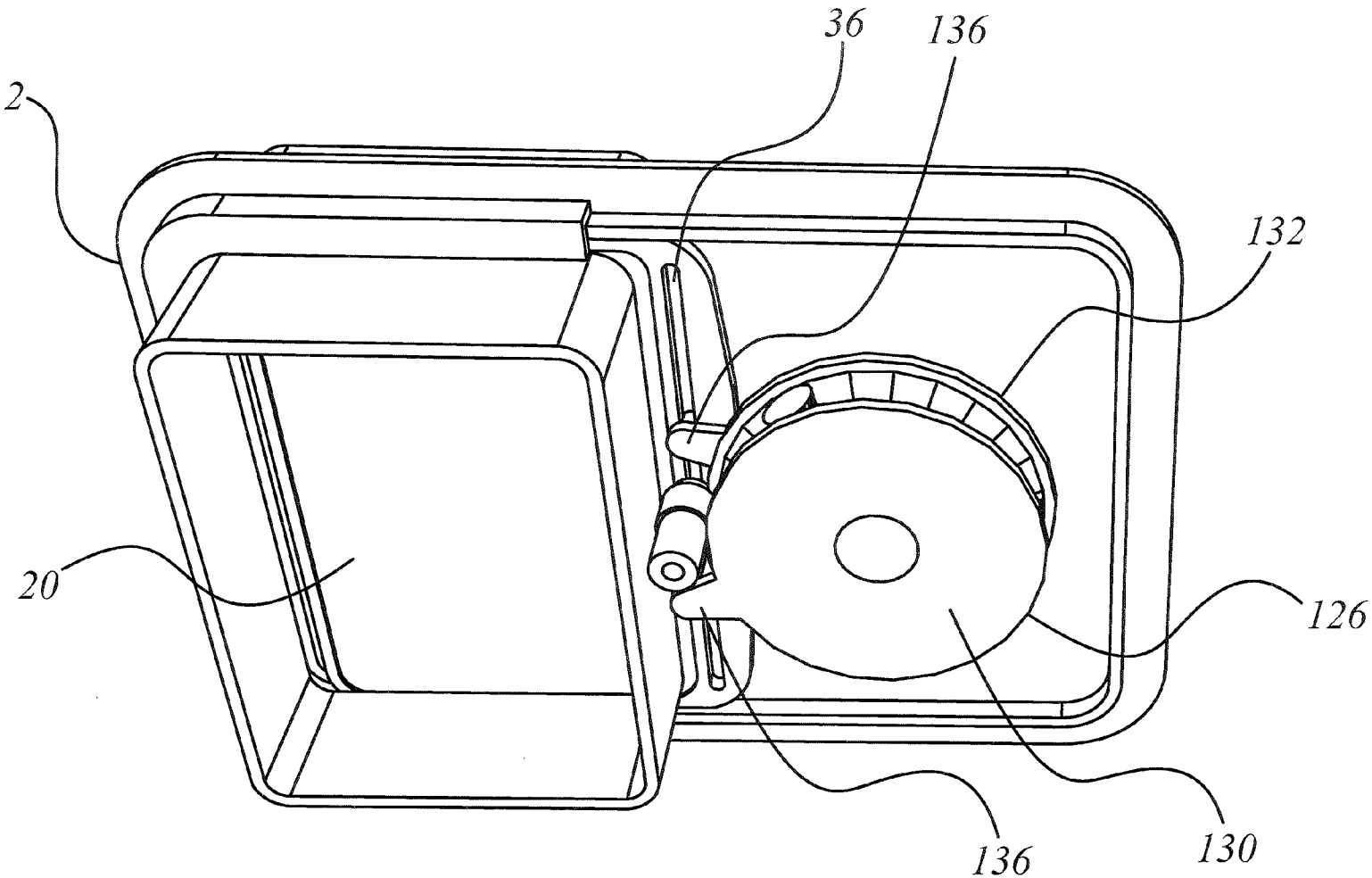
FIG. 3 is a perspective front/top view of the device, partially disassembled to provide a view of the interior of the housing and of one embodiment of the door positioning mechanism.
Figure 4:
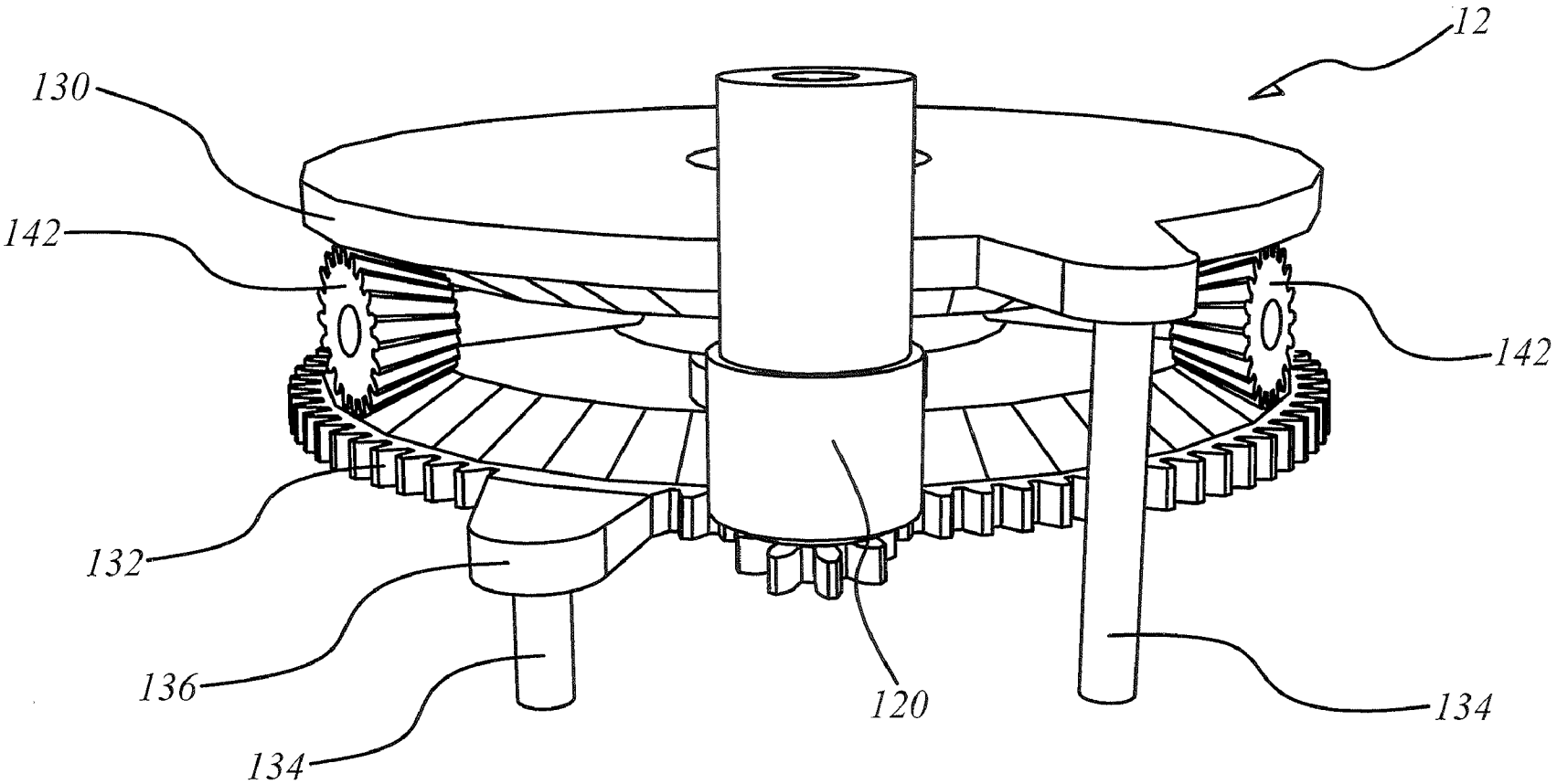
FIG. 4 is a perspective side view of one embodiment of the door positioning mechanism.

In an alternative embodiment the mechanical positioning component 126 comprises a pair of counter-rotating disks 130,132 linked by one or more planetary gears 142. See FIGS. 3 and 4. The disks 130,132 have substantially the same diameters and are oriented such that their respective centers are substantially aligned. The disks 130,132 are configured such that when one disk 130 is rotated by the electric motor 120 in a first direction, the other disk 132 is rotated simultaneously in an opposite direction relative to the first disk 130 by action of the one or more planetary gears 142. When one disk 130 is rotated in a second direction by the electric motor 120, opposite the first direction, the other disk 132 is rotated simultaneously in an opposite direction relative to the first disk 130.

Each disk 130,132 comprises a pin 134 depending substantially vertically from the disk 130,132 and located proximate to the edge of the disk 130,132. The pins 134 may be located on small flanges 136 extending from the edge of each disk 130,132, said flanges 136 located substantially within the planes of their respective disks 130,132. Both pins 134 depend from their respective disks 130,132 in the same direction. Each pin 134 is adapted to fit into the vertical door slot 36. Rotation of the disk 130,132 moves the pin 134 along an arc, simultaneously sliding the pin 134 along the door slot 36, moving the door 20, as described above. When the electric motor 120 operates in a first direction, both disks 130,132 are rotated simultaneously in opposite directions, with their respective pins 134 moving together (in opposite directions) to move the door 20 smoothly in a first direction. When the electric motor 120 operates in a second direction, both disks 130,132 are rotated simultaneously in opposite directions, in the reverse of their directions during operation of the electric motor 120 in the first direction, with their respective pins 134 moving together (in opposite directions) to move the door 20 smoothly in a second direction. The use of a pair of disks 130,132 and a pair of pins 134 establishes two points of contact between the mechanical positioning component 126 and the door 20, providing a smoother movement of the door 20 and minimizing binding.

Figure 5A:
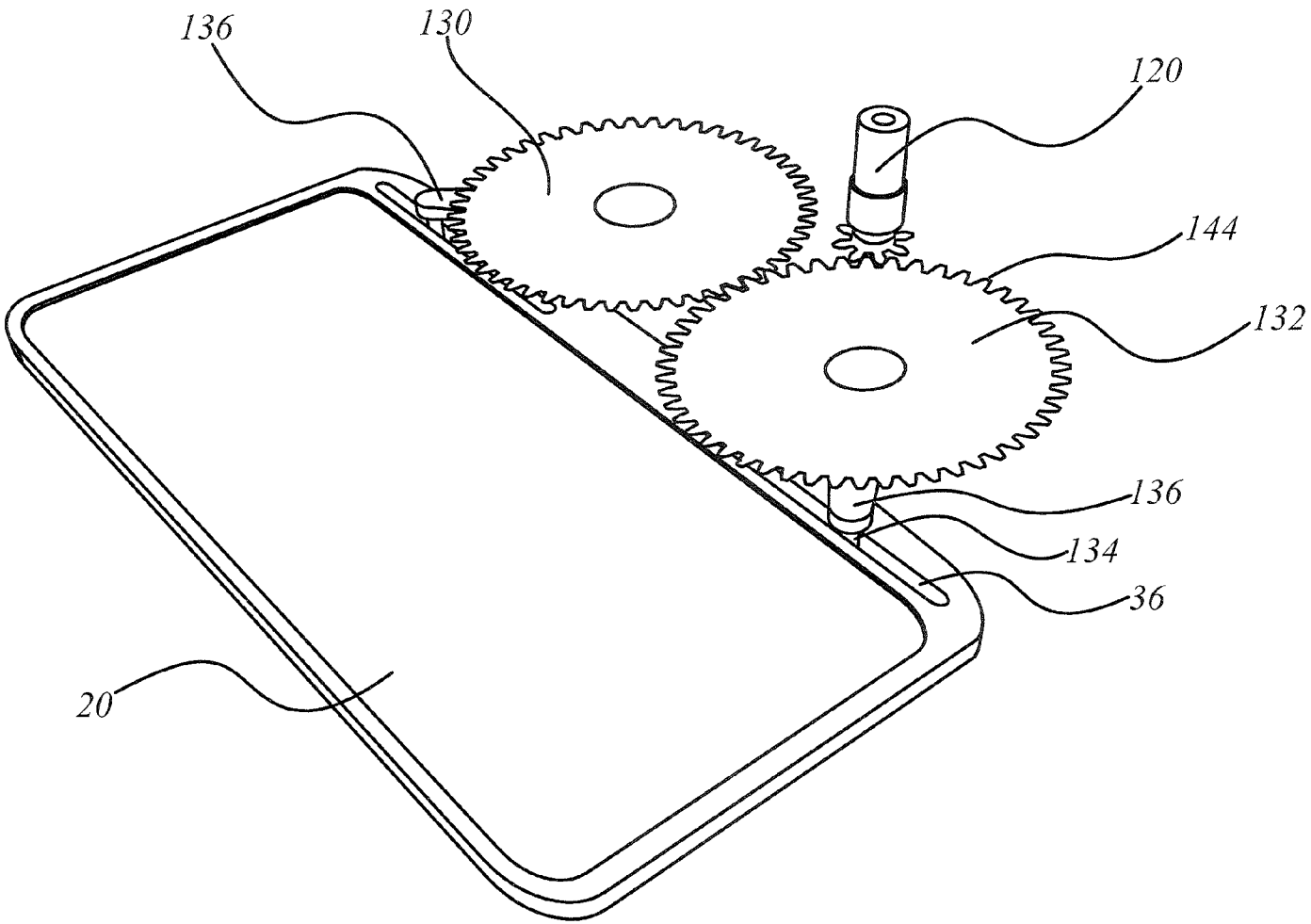
FIG. 5A is a perspective side view of another embodiment of the door positioning mechanism.

In an alternative to the foregoing embodiment, the pair of disks 130,132 lie next to each other in substantially the same plane, with their respective edges in contact with each other. See FIG. 5A. The pair of disks 130,132 is linked by circumferential gearing comprising teeth 144 depending outward from the edges of the disks 130,132. Each disk 130,132 is configured with a pin 134, as described above. The disks 130,132 are configured such that when one disk 130 is rotated by the electric motor 120 in a first direction, the other disk 132 is rotated simultaneously in an opposite direction relative to the first disk 130 by action of the circumferential teeth 144. When one disk 130 is rotated in a second direction by the electric motor 120, opposite the first direction, the other disk 132 is rotated simultaneously in an opposite direction relative to the first disk 130. As described above, the counter rotation of the disks 130,132 moves their respective pins 134 in opposing arcs, moving the door 20 smoothly. This embodiment allows for greater separation of the pins 134, thereby improving the smoothness of the movement of the door 20, especially if the door 20 is of greater height to accommodate larger pets 18.

Figure 5B:
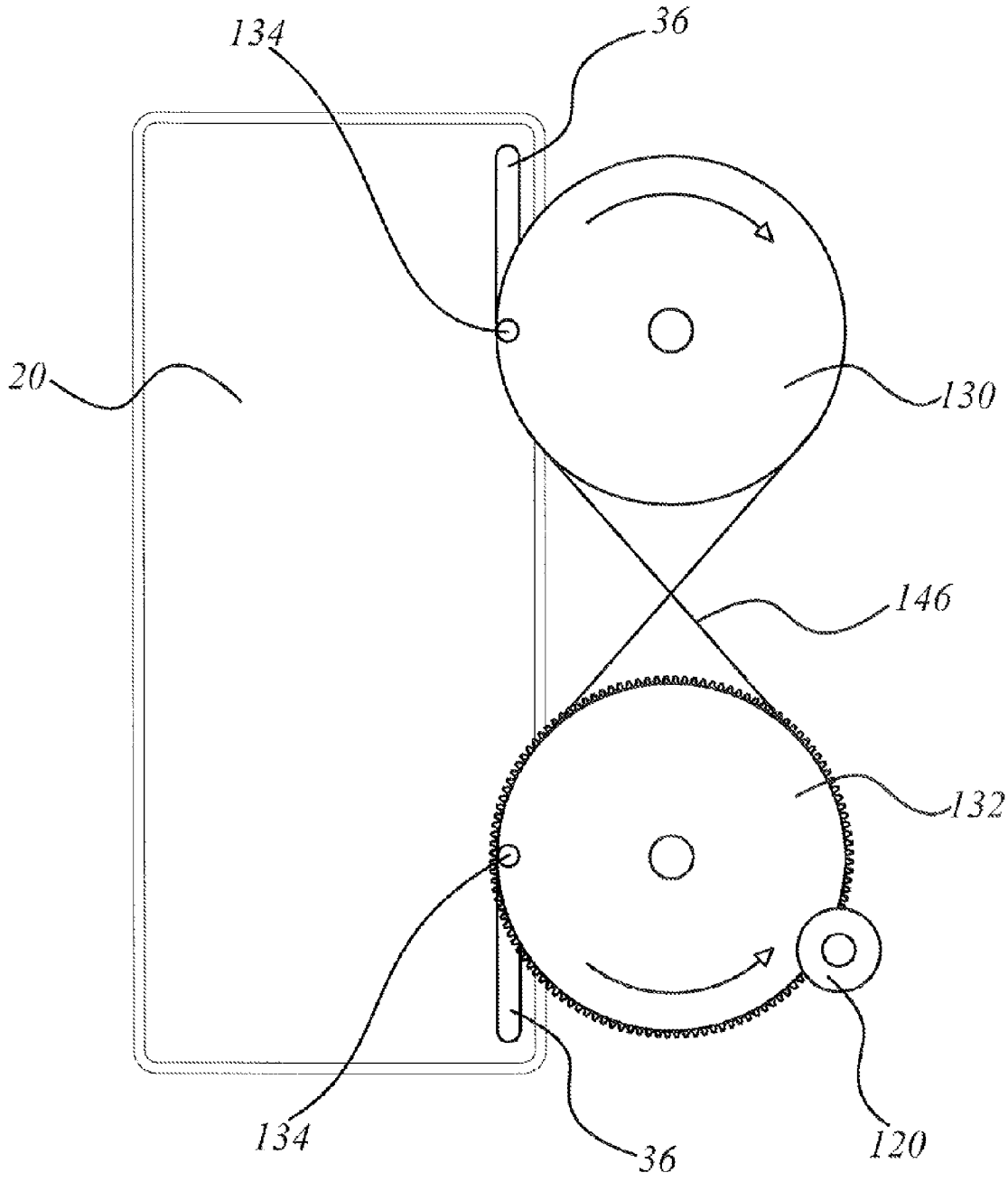
FIG. 5B is a schematic plan front view of another embodiment of the door positioning mechanism.

In yet another alternative to the foregoing embodiment, the pair of disks 130,132 lie next to each other in substantially the same plane, separated some distance from each other. See FIG. 5B. The pair of disks 130,132 is linked by a belt 146, preferably a serpentine belt. Each disk 130,132 is configured with a pin 134, as described above. The disks 130,132 are configured such that when one disk 130 is rotated by the electric motor 120 in a first direction, the other disk 132 is rotated simultaneously. Depending on the belt 146 configuration, the disks 130,132 may rotate in the same or in an opposite directions relative to each other. When one disk 130 is rotated by the electric motor 120 in a second direction, the other disk 132 is rotated simultaneously; again, depending on the belt 146 configuration, the disks 130,132 may rotate in the same or in an opposite direction relative to each other. As described above, the rotation of the disks 130,132 moves their respective pins 134 in arcs, moving the door 20 smoothly. This embodiment allows for even greater separation of the pins 134, thereby improving the smoothness of the movement of very large doors 20.

The control component 128 of the device 1 comprises an activation component 152, a timer 158, and a motor controller 160. See FIG. 10. The activation component 152 is in connection with the motor controller 160; upon the occurrence of an appropriate activation event, the activation component 152 causes the motor controller 160, which is in connection with the electric motor 120, to activate the operation of the electric motor 120 in a first direction such that the mechanical positioning component 126 draws the door 20 into the housing component 4, thereby uncovering the pet access aperture 16. Once the door 20 is in the fully opened position the electric motor 120 is deactivated and the timer 158 is activated. The timer 158, which is in connection with the motor controller 160, upon the expiration of a predetermined period of time after its activation, causes the motor controller 160 to activate the operation of the electric motor 120 in a second direction opposite the first direction such that the mechanical positioning component 126 pushes the door 20 out of the housing component 4, thereby covering the pet access aperture 16. Once the door 20 is in the fully closed position the electric motor 120 is deactivated. In one embodiment, the time-out period for the timer 158 is five seconds. In another embodiment, the time-out period may be adjusted as desired. As a safety feature, the electric motor 120 is suitably adapted to provide the minimal force necessary to position the door 20. Thus, if a pet 18 remains within the pet access aperture 16 when the door 20 is in the process of closing, the contact of the door 20 with the pet 18 will not harm the pet 18. Additionally, a mechanism within the mechanical positioning component 126 causes the door 20 to retract in such situations. Such a mechanism could be an amperage monitor, though other devices known in the art may also be used. Other embodiments of the control component 128 may be evident to those skilled in the art. This specification contemplates and incorporates all such embodiments for use with the device 1.

The activation component 152 of the control component 128 comprises the pet identification component 14, in connection with the motor controller 160. The occurrence of an appropriate activation event is identified by the pet identification component 14 which then signals the motor controller 160 to begin the sequence of opening and closing the door 20. In one embodiment, the identification component 14 comprises a key device 170, also known as a transponder, adapted to be carried by a pet 18 and suitably adapted to transmit a radio signal 162 in an identifiable manner, and a radio frequency identification component 172, also known as an interrogator or reader, situated within the housing component 4 and suitably adapted to transmit and receive radio signals 162 a short distance exterior to the housing component 4 and in near proximity to the door 20. The key device 170 is energized by the radio signals 162 transmitted by the radio frequency identification component 172; it therefore does not need its own independent power supply. The combination of a key device 170 and a radio frequency identification component 172 is well known in the industry. In one embodiment, the radio frequency identification component 172 is adapted to generate a weak radio signal 162 with an effective range of a few inches of the door 20. An antenna 173, integrated into the casing 2, monitors for the presence of radio signals 162 generated by the key device 170. When the key device 170 is brought within the field of the radio signals 162, it is energized by the radio signals 162 transmitted by the radio frequency identification component 172 and in turn transmits its own signal 162, which is received by the radio frequency identification component 172.

The radio frequency identification component 172 compares the radio signal 162 received from the key device 170 against a predetermined selection; a match indicates that the key device 170 corresponds to an authorized pet 18 and the door opening sequence is initiated. Multiple key devices 170 may be used with the device 1. A new key device 170 is initialized by placing it within the field of radio signals 162 transmitted by the radio frequency identification component 172 and causing the radio frequency identification component 172 to register the key device 170 for future identification. In one embodiment the key device 170 is a collar tag to be worn by the pet 18. In another embodiment the key device 170 may be a subcutaneous implant. Thus, other pets 18 wearing similar key devices 170 can be screened, and access to the device 1 can be accurately controlled to the individual pet 18. This is an improvement over other devices disclosed in the prior art using non-specific identification keys, such as magnets, which would permit access to any pet 18 wearing a magnet key. In high density populations the number of pets 18 carrying identification keys is likely to be significant, thereby the use of an identification component 14 as disclosed herein increases the effectiveness of access control over the prior art devices which use non-specific keys for controlling access. Other embodiments of the radio frequency identification component 172 may be utilized in the device 1, provided the function of individual pet identification is met.

In yet another embodiment, the activation component 152 further comprises a bypass switch 168. See FIG. 1. The bypass switch 168 is in connection with the motor controller 160 and is suitably adapted to send a signal to the motor controller 160 when the bypass switch 168 is manually activated. In one embodiment the bypass switch 168 is mounted on the housing component 4.

In one embodiment of the device 1, the control component 128 further comprises a data entry pad 174 and a first interface component. See FIG. 1. The first interface component is in connection with the data entry pad 174 and is suitably adapted to communicate data between the data entry pad 174 and the control component 128 to perform control functionality. In this embodiment, the data entry pad 174 may be used to set the time-out period of the timer 158, to select which of multiple key devices 170 will be permitted access, to establish timing and directional restrictions on an individual pet's 18 access to the device 1, and to control other aspects of the device 1. The data entry pad 174 may be configured any number of ways, including having a numeric keypad, or up/down scroll buttons, or other suitable means for accomplishing the desired functionality. In the preferred embodiment the data entry pad 174 is located on an exterior portion of the housing 4 oriented at an angle, so that the data entry pad 174 is accessible whether the device 1 is oriented horizontally or vertically.

In another embodiment of the device 1, the control component 128 further comprises a second interface component suitably adapted to communicate with a computer for data gathering, processing, and control functionality. Thus, a user can not only modify control aspects of the device 1, but can also gather and analyze data concerning the use patterns of the device 1 by authorized pets 18. Utilizing the functionality of the internet, the second interface component may allow control and monitoring of the device 1 from remote locations, such as when a pet owner is on vacation. The second interface component is adapted for use with a personal computer utilizing software appropriate for the functionality desired.

As described, the device 1 is an improved design for an automatic pet access door over the prior art. The device 1 incorporates a pet-specific identification component 14 to better restrict access to only authorized pets 18.

Modifications and variations can be made to the disclosed embodiments of the device 1 without departing from the subject or spirit of the device 1 as defined in the following claims.

What I claim:

1. A pet door device, comprising a casing, having a housing component, a door positioning component, and an identification component, wherein the casing contains a pet access aperture through which a pet may pass and a sliding door suitably adapted for covering and uncovering the pet access aperture;

the door positioning component is situated within the housing component, is electrically powered is activated by the pet, moves the door to cover and uncover the pet access aperture, and comprises an electric motor, a power supply, in connection with the electric motor and adapted to provide power to the electric motor, a mechanical positioning component, situated within the housing component, and a control component;

whereby the electric motor, as controlled by the control component, causes the mechanical positioning component to laterally move the door between a closed position in which the pet access aperture is covered and an opened position in which the pet access aperture is uncovered;

the identification component discerns between individual animals and permits access through the door only to designated pets under predetermined conditions; and the mechanical positioning component of the door positioning component comprises a first disk, said first disk oriented in a plane parallel to the plane of travel of the door, said first disk being capable of rotation by the electric motor, said first disk comprising a pin extending substantially perpendicularly from said first disk and located proximate to an edge of said first disk, and a second disk, said second disk oriented in a plane parallel to the plane of travel of the door, said second disk being capable of rotation by the first disk, said second disk comprising a pin extending substantially perpendicularly from said second disk and located proximate to an edge of said second disk, with said second disk having substantially the same diameter as the first disk and being oriented such that its center is substantially aligned with the center of the first disk;

wherein the first disk and the second disk are attached to each other in a counter-rotational configuration linked by one or more planetary gears, the pin of the first disk and the pin of the second disk both extend from their respective disks in the same direction, the pin of the first disk is adapted to fit into a slot formed into the door proximate to an edge of the door, and the pin of the second disk is adapted to fit into the slot formed into the door;

whereby rotation of the first disk by the electric motor in a first direction simultaneously rotates the second disk in a second and opposite direction through the action of the one or more planetary gears, rotation of the first disk by the electric motor in the second direction simultaneously rotates the second disk in the first direction through the action of the one or more planetary gears, rotation of the first disk by the electric motor in the first direction moves the pin of the first disk along an arc, simultaneously sliding the pin of the first disk along the slot formed into the door, moving the door in a direction to uncover the pet access aperture, rotation of the second disk by the first disk in the second direction moves the pin of the second disk along an arc, simultaneously sliding the pin of the second disk along the slot formed into the door, moving the door in a direction to uncover the pet access aperture, rotation of the first disk by the electric motor in the second direction moves the pin of the first disk along a reverse arc, simultaneously sliding the pin of the first disk along the slot formed into the door in an opposite direction, moving the door in an opposite direction to cover the pet access aperture, and rotation of the second disk by the first disk in the first direction moves the pin of the second disk along a reverse arc, simultaneously sliding the pin of the second disk along the slot formed into the door in an opposite direction, moving the door in an opposite direction to cover the pet access aperture.

2. The device of claim 1, wherein the control component comprises a motor controller, an activation component, and a timer;

wherein the motor controller is in connection with the electric motor, the activation component is in connection with the motor controller and the timer and is capable of causing the motor controller to activate the operation of the electric motor in a first direction to uncover the pet access aperture and in a second direction to cover the pet access aperture and of activating the timer, and the timer is in connection with the motor controller;

whereby upon the occurrence of a first predetermined condition the activation component causes the motor controller to activate the operation of the electric motor in the first direction and activates the timer, upon the occurrence of a second predetermined condition the activation component causes the motor controller to activate the operation of the electric motor in the second direction, and upon the expiration of a predetermined period of time after activation of the timer the timer causes the motor controller to activate the operation of the electric motor in the second direction.

3. The device of claim 2, wherein the activation component comprises the identification component, in connection with the motor controller;

wherein the identification component is suitably adapted to signal the motor controller when a predetermined identification event occurs.

4. The device of claim 3, wherein the identification component comprises a key device, adapted to be carried by a pet and suitably adapted to transmit a radio signal in an identifiable manner, and a radio frequency identification component, situated within the housing component, suitably adapted to transmit and receive radio signals a short distance exterior to the housing component and in near proximity to the door and to identify radio signals transmitted by the key device.

5. The device of claim 3, wherein the activation component further comprises a bypass switch, in connection with the motor controller;

wherein the bypass switch is suitably adapted to signal the motor controller when the bypass switch is manually activated.

6. The device of claim 2, wherein the control component further comprises a data entry pad, situated on the casing, and a first interface component, in connection with the data entry pad and suitably adapted to communicate data between the data entry pad and the other components of the control component for the purpose of controlling functionality of the device.

7. The device of claim 2, wherein the control component further comprises a second interface component suitably adapted to communicate with a computer for data gathering, processing, and control functionality.

8. The device of claim 1 further comprising a pet access platform component, the pet access platform component situated adjacent to the pet access aperture providing the pet with a platform next to the door on which to stand when the device is located above ground or floor level.

9. The device of claim 8, wherein the pet access platform further comprises an exterior ramp removably attached to the pet access platform.

10. The device of claim 1 further comprising an enclosure, said enclosure removably attached to the exterior of the casing wherein the enclosure fully encloses the area immediately adjacent to the pet access aperture thereby restricting the pet to that area.

* * * * *